US006155089A

United States Patent [19]

Hurskainen et al.

[11] Patent Number: 6,155,089

[45] Date of Patent: Dec. 5, 2000

[54] ELECTROMECHANICAL CYLINDER LOCK

[75] Inventors: Oiva Hurskainen, Joensuu; Hannu Sivonen, Marjovaara, both of Finland

[73] Assignee: Abloy Oy, Joensuu, Finland

[21] Appl. No.: 09/272,804

[22] Filed: Mar. 19, 1999

[30] Foreign Application Priority Data

Mar. 20, 1998 [FI] Finland ..... 980634
May 29, 1998 [FI] Finland ..... 981197

[51] Int. Cl.[7] ..... E05B 29/04; E05B 49/02

[52] U.S. Cl. ..... 70/278.3; 70/187; 70/283.1; 70/366; 70/453

[58] Field of Search ..... 70/188, 189, 283.1, 70/222, 223, 366, 422, 278.2, 278.3, 278.7, 279.1, 277, 278.6, 417, 453

[56] References Cited

U.S. PATENT DOCUMENTS

| | | | |
|---|---|---|---|
| 3,785,188 | 1/1974 | Drathschmidt | 70/276 |
| 4,370,875 | 2/1983 | Piiroinen | 70/422 |
| 4,416,127 | 11/1983 | Gomez-Olea Naveda | 70/276 |
| 4,534,194 | 8/1985 | Aydiu | 70/278.2 |
| 4,854,143 | 8/1989 | Corder et al. | 70/218 |
| 4,956,984 | 9/1990 | Chi-Cheng | 70/277 |
| 5,337,588 | 8/1994 | Chhatwal | 70/278.3 |
| 5,373,718 | 12/1994 | Schwerdt et al. | 70/278.3 |
| 5,447,047 | 9/1995 | Lin | 70/218 |
| 5,791,177 | 8/1998 | Bianco | 70/223 X |

FOREIGN PATENT DOCUMENTS

| | | | |
|---|---|---|---|
| 0 452 298 | 10/1991 | European Pat. Off. . | |
| 0 528 513 | 2/1993 | European Pat. Off. . | |
| 0 780 531 | 6/1997 | European Pat. Off. . | |
| 98947 | 5/1997 | Finland . | |
| 2515720 | 5/1983 | France | 70/278.3 |
| 2 687 426 | 8/1993 | France . | |
| 39 02 992 | 3/1990 | Germany . | |
| 505 493 | 9/1997 | Sweden . | |
| 2071197 | 9/1981 | United Kingdom | 70/278.3 |
| 2169649 | 7/1986 | United Kingdom | 70/278.3 |
| 2178476 | 2/1987 | United Kingdom | 70/278.3 |
| 2 305 965 | 4/1997 | United Kingdom . | |
| WO80/01299 | 6/1980 | WIPO | 70/278.2 |

*Primary Examiner*—Lloyd A. Gall
*Attorney, Agent, or Firm*—John Smith-Hill; Smith-Hill and Bedell

[57] ABSTRACT

An electromechanical cylinder lock includes a lock body and a turnable lock cylinder and a locking mechanism inside the lock body. The locking mechanism normally prevents turning of the lock cylinder relative to the lock body and can be moved by a key of the lock to a releasing position allowing turning of the lock cylinder. The key for the lock includes a transmitter for transmitting an electronic code and the lock correspondingly includes a receiver for receiving and identifying the code of the key. When the receiver detects the correct code the receiver enables mechanical opening of the lock by the key. The lock includes a locking disc with a key opening which is so designed that the turning of the key does not directly act mechanically on the locking disc. The lock also includes a coupling element for coupling the locking disc to the turning movement of the key. The lock is provided with an electric operator which is activated by the electronic code from the key and which in an active state controls the coupling element so that the locking disc turns with the key to a position required for opening of the locking mechanism.

26 Claims, 7 Drawing Sheets

7a
7
12
11
5
2a
30
8
10c
10b
9c
9
9b
6
2
2a
17
10
10a
10c
10d
9a
9c
1
3a
3
3a
3
3a
4
3a
3
4

Fig. 4
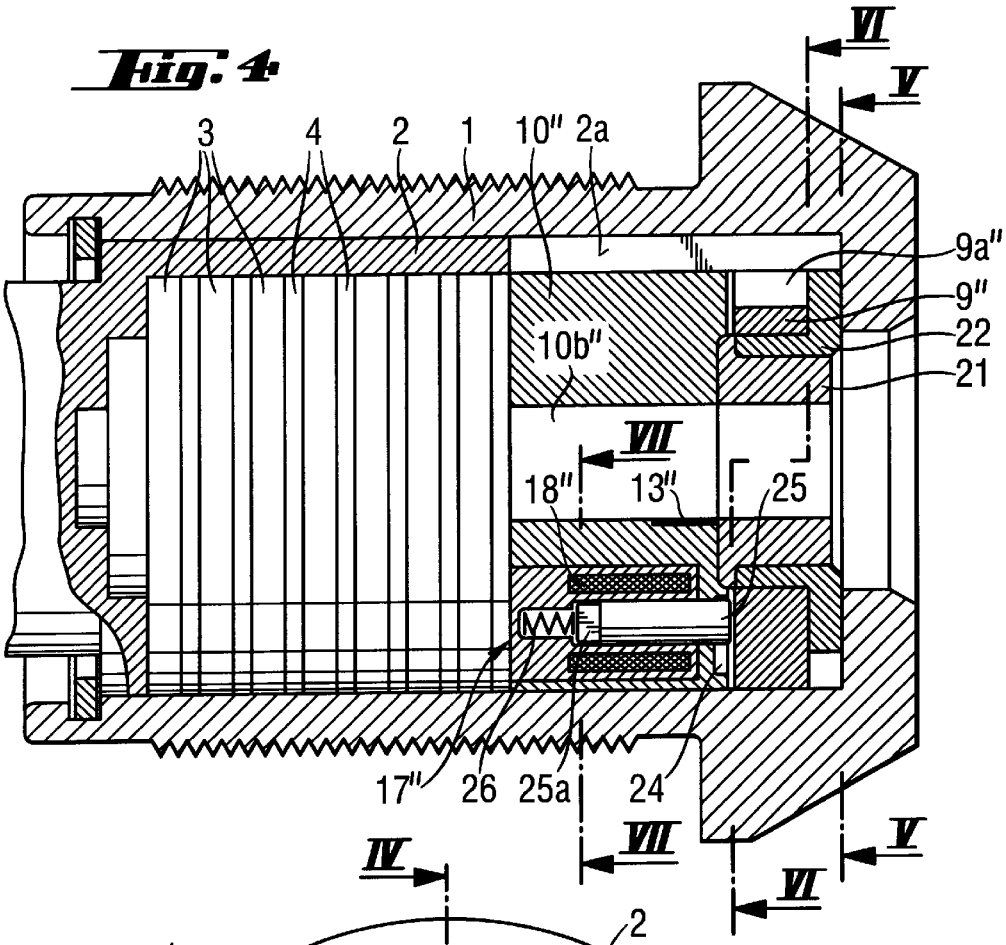
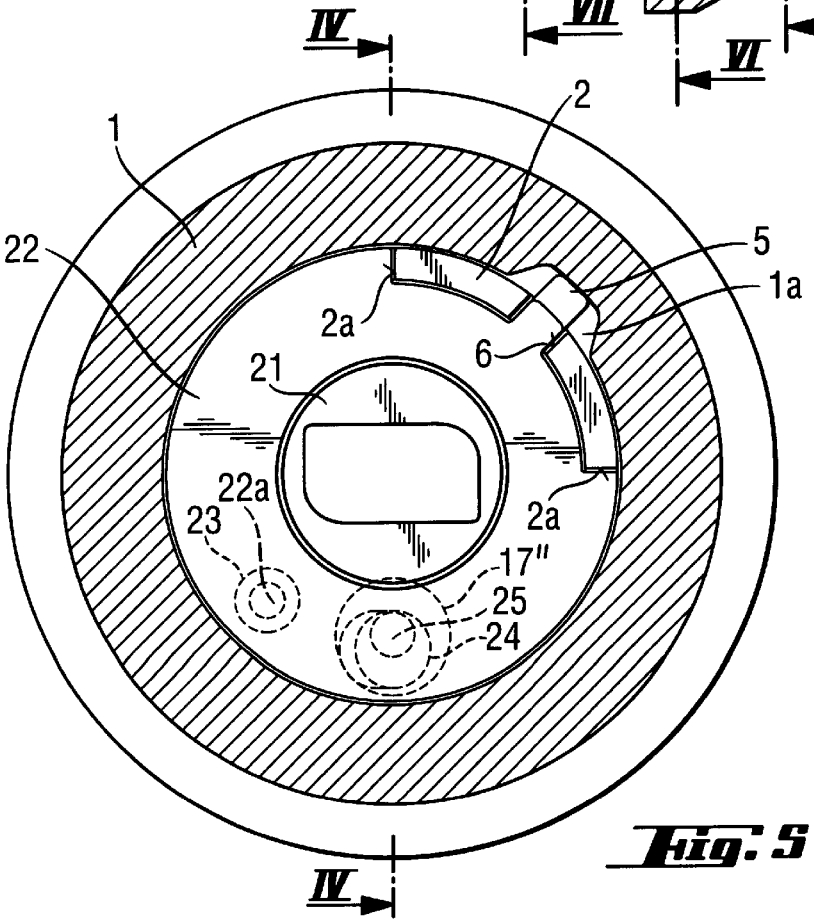
Fig. 5

ELECTROMECHANICAL CYLINDER LOCK

BACKGROUND OF THE INVENTION

This invention relates to an electromechanical cylinder lock.

It is well known that the operation of a cylinder lock mechanism can be controlled by means of an electronic code to be fed from a key. For this purpose the lock can be provided with a blocking member or the like which normally prevents the use of the key. When the code supplied from the key is identified to be correct, a control logic of the lock causes movement of the blocking member into a position allowing turning of the locking mechanism and, thus, opening or release of the lock application. Arranging a blocking member in the lock body and guiding its movements requires space, however, and often also modifications in the construction of the lock mechanism. In order to provide the movement of the blocking member a solenoid with sufficient power and power supply therefor is required, which also makes the construction more complicated and increases the costs thereof.

An aim of the invention is to provide a new electromechanical cylinder lock, in which the control of members in the locking mechanism to be provided as a consequence of an identification of an electronic code to be fed from the key is so arranged that the arrangement is advantageous as to its requirement of space and costs and entails as little changes to the actual locking mechanism as possible. A further aim of the invention is to create a solution, in which the members of a selected locking mechanism can be utilized so that separate blocking members are not necessarily needed.

SUMMARY OF THE INVENTION

According to the invention the lock includes a special locking disc with a key opening which is so designed that the turning of the key does not directly act mechanically on the locking disc, as well as coupling means for selectively coupling the special locking disc to the turning movement of the key. The lock is additionally provided with electric operating means to be activated by means of the electronic code from the key and which in their active state are arranged to control the coupling means so that the special locking disc turns with the key to a position required for the opening of the locking mechanism.

Thus, according to the invention turning of the special locking disc takes place only in connection with feeding of a correct code by making use of a coupling arrangement to be separately accomplished by means of electric operating means. In case of an erroneous code the special locking disc is not turned at all, but it does not prevent turning of the key either. In the case of a cylinder lock provided with a locking mechanism based on turnable locking discs, opening of the lock mechanism by means of a key provided with a correct mechanical opening combination but an incorrect electronic code is prevented by the conventional locking bar and the special locking disc.

The lock body is with advantage provided with a control unit which turns always with the key and in which the electric operating means are arranged. The control unit is provided with a key channel the cross-section of which corresponds to the cross-sectional profile of a shank part of the key for the lock. In addition the control unit includes with advantage the means for receiving and identifying the key code.

In order to provide a more uncomplicated construction the key for the lock is provided with a power source and electric contact means. In this case the control unit includes electric contact means which are arranged in cooperation with the electric contact means in the key and which, after identification of a correct electronic key code, are arranged to connect current from the power source in the key to the electric operating means. The electric contact means of the control unit are with advantage exposed at the interior of the key channel.

In order to secure undisturbed operation for the special locking disc the turning range of the control unit and the special locking disc is limited with regard to the lock cylinder, preferably so that it corresponds at most to the selecting movement for the lock mechanism, whereby (in the case of a disc cylinder lock) the normal locking discs read the mechanical combination from the key. In addition the control unit may be provided with a protrusion or like member which acts on the special locking disc and which is arranged to return the locking disc together with the control unit and the key into the initial position of the locking mechanism. Since the returning of the locking disc is in this case carried out under positive guidance, power supply can be disconnected immediately after opening of the lock mechanism for economizing the batteries.

In an advantageous embodiment of the invention the electric operating means comprise electromagnetic means serving as the coupling means and in addition the special locking disc is of ferromagnetic material and is located in the immediate vicinity of the control unit. In this case, thus, the turning of the special locking disc is carried out by a magnetic force created by the electromagnetic means, whereby no separate blocking member is needed, which is of advantage from the viewpoint of simple construction and utilization of space. The current needed for this kind of an electric control is also rather small in comparison with conventional solutions.

In an alternative embodiment of the invention the electric operating means include coupling means operated by an electromagnet or the like and which are movable from their free non-coupling position into their coupling position, in which they are arranged to mechanically engage the special locking disc so that when the control unit is turned by means of the key the special locking disc turns together with the control unit.

In a third embodiment of the invention the special locking disc is provided with a spring-loaded coupling member which is movable transversely with regard to the turning movement of the locking disc between two end positions in which it protrudes out from the locking disc. In this case the electric operating means can with advantage be arranged to control the movements of the coupling member for controlling the turning of the special locking disc.

In order to control movement of the coupling member, the electric operating means may comprise an actuating member operated by an electromagnet or the like and turnable between two turning positions so that in one of its turning positions the actuating member is movable in its axial direction, whereby the actuating member is arranged in cooperation with the coupling member for controlling the turning of the special locking disc.

In this case the control unit includes with advantage a coupling recess or the like arranged at the position of the actuating member. The coupling member is urged by its spring into the coupling recess.

At an initial position of the control unit and the special locking disc, corresponding to the insertion position of the key, the coupling member is angularly spaced at a certain turning angle, for instance about 45°, from the coupling recess so that the coupling member and the coupling recess are opposite to each other when the key, together with the control unit, is turned in the lock through this turning angle from its initial position. In addition the lock includes a guiding disc which is located beside the special locking disc on the opposite side with respect to the control unit. The guiding disc is held against turning relative to the lock cylinder and is formed with a coupling recess into which the coupling member is pressed against the force of its spring in the initial position of the key thereby preventing turning of the special locking disc. Hereby it is secured that also in this embodiment the special locking disc is not turned at all unless a correct electronic code is fed into the lock to control the coupling means to connect the special locking disc to turn to a position required for opening of the locking mechanism. Since in this case a coupling cannot be accomplished in the initial position of the locking members, possible manipulation of the coupling member when the key is not in the lock can be prevented.

The invention can with advantage be applied to a cylinder lock with the so called turnable or rotatable locking discs. In this case the lock is provided with a set of locking discs which are mechanically turnable by means of the key of the lock. The locking discs are located inside of the lock cylinder and they are each provided with a peripheral notch determining the opening combination of the lock. The locking means comprise additionally a locking bar, which in its locking position together with the locking discs prevents turning of the lock cylinder relative to the lock body and which is movable into a releasing position allowing said turning when the locking discs are first turned by means of the key into a position required by the opening combination. In this case the control unit is with advantage located inside of the lock cylinder and it includes a groove corresponding to the peripheral notches of the locking discs for the locking bar of the lock. Thereby the basic functions and components of the normal mechanical cylinder lock construction with the locking discs can be utilized.

Some embodiments of the invention can be utilized also in case the locking means which control the turning of the lock cylinder with respect to the lock body comprise a pin tumbler mechanism known as such. In this case separate means for blocking the turning of the lock cylinder may be arranged for the special locking disc or side bar arrangements utilized in many pin tumbler mechanisms for providing additional security may be utilized.

BRIEF DESCRIPTION OF THE DRAWINGS

In the following the invention is described, by way of example, with reference to the attached drawings, in which FIG. 4 shows an axial section of a third cylinder lock arrangement according to the invention with the locking members being shown in an initial position or in a position corresponding to the insertion position of the key, FIG. 5 shows a sectional view on the line V—V of FIG. 4.

DETAILED DESCRIPTION

Figure 1:
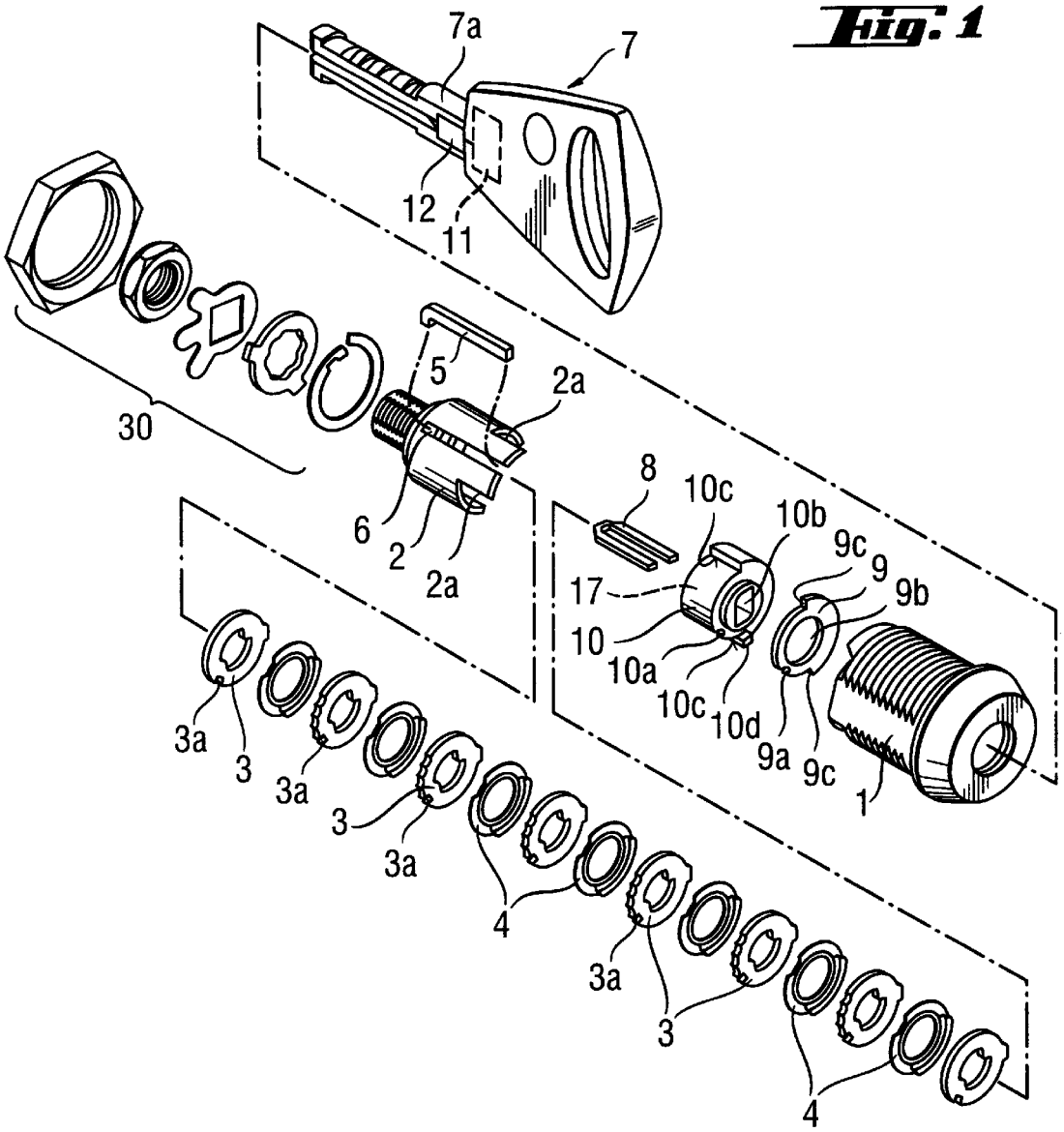
FIG. 1 shows an exploded view of a first electromechanical cylinder lock arrangement according to the invention.

In the drawings 1 indicates a lock body of a cylinder lock, with a turnable lock cylinder 2 which for its part encloses a set of locking discs 3 each provided with a peripheral notch 3*a* and intermediate discs 4 separating the locking discs 3 from each other. The mechanism includes also a locking bar 5, which in its locking position is located partly in a groove 1*a* in the inner surface of the lock body 1 and partly in a slot 6 in the lock cylinder 2 (cf. FIG. 6) preventing turning of the lock cylinder 2 with respect to the lock body 1.

Installation of the lock cylinder 2 into the lock body 1 and installation of the whole cylinder lock at its place of use is carried out by members 30 in a way known as such.

The set of locking discs includes also in accordance with FIG. 1 a special locking disc 9, which in the embodiment of FIG. 1 is made of ferromagnetic material, and a control unit 10 which turns continuously with a key 7 of the lock and includes electric operating means 17. The control unit 10 and the electric operating means 17 are located inside the lock cylinder 2.

The locking disc 9 has a peripheral notch 9*a* and an opening 9*b* for the key. The opening 9*b* is so designed that it has no counter surface for the key, whereby it cannot be directly turned by means of the key. Correspondingly the control unit 10 has a peripheral groove 10*a* corresponding to a normal peripheral notch and a key channel 10*b*, the cross-section of which corresponds to the cross-sectional profile of the shank 7*a* of the key exclusive of any combination surfaces that control the opening of the lock. In addition the control unit has counter surfaces 10*c* and the locking disc 9 correspondingly has counter surfaces 9*c*, which cooperate with guiding surfaces 2*a* of the lock cylinder 2 so that the turning range of the parts 9 and 10 with respect to the lock cylinder 2 corresponds to the turning angle, typically about 90°, required for opening of the lock mechanism. A protrusion 10*d* of the control unit acts on one of the counter surfaces 9*c* of the locking disc 9 and secures returning of the locking disc 9 always to its initial position when the key is used to turn the control unit 10 to its initial position.

In the embodiment of FIG. 1 the electric operating means 17 in the control unit 10 comprise electromagnetic means. When current is connected to the electric operating means 17, a magnetic field is created affecting the locking disc 9 so that the locking disc 9 is clamped magnetically to the control unit. Consequently, when the control unit 10 is turned by the key, the locking disc 9 turns with the control unit 10. Thus, current being connected, when the locking discs 3, the control unit 10 and with it the locking disc 9 are turned by means of the key into a position in which the peripheral notches 3*a* and 9*a* and the peripheral groove 10*a* form a uniform channel at the position of the slot 6, the locking bar 5 can enter this channel and the lock mechanism is released, whereby upon further turning of the key the turning movement can be transmitted through the lock cylinder in a way as is required by different applications. In order to engage or lock the lock mechanism, the key is turned in the opposite direction, whereby the locking bar 5 moves back to its locking position preventing turning of the lock cylinder. In the application of the figures returning of the locking discs 3 takes place by means of a separate returning bar 8. The operation of the basic mechanism is explained in detail for instance in U.S. Pat. No. 5,490,405.

In practice a coil (not particularly shown in FIG. 1) may with advantage serve as the electromagnetic means of the control unit 10, whereby when there is current in the coil the magnetic force created thereby keeps the locking disc 9 clamped to the control unit 10 when the key is turned in the lock. On the other hand when there is no current in the coil, the locking disc 9 is not clamped to the control unit and does not turn with the control unit 10 when the control unit is turned by means of the key. This is primarily due to frictional resistance. On the other hand even if the locking disc 9 did turn somewhat with the control unit 10, the result would not be releasing of the lock mechanism, since in order that the locking bar 5 be released the locking disc 9 must be turned the full angular range of selection. Correspondingly when the key and, thus, the control unit 10 is turned back to its initial position, the protrusion 10*d* of the control unit secures returning of the locking disc 9 also to its initial position.

Figure 2:
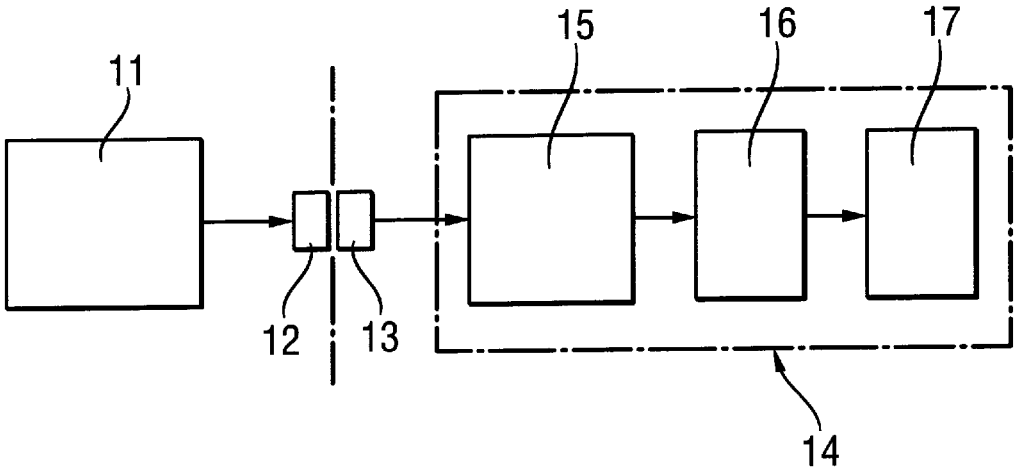
FIG. 2 shows schematically operational principles of an electric part of the arrangement shown in FIG. 1.

The lock and the key include electronic parts of their own, on the basis of the cooperation of which it is determined when to connect current to the coil of the control unit 10, so that the cylinder lock mechanism can be opened by a key provided with the correct mechanical opening combination. This is illustrated by FIG. 2.

The key 7 is provided with an electronic part 11, which comprises means for storing and transmitting an electronic code and a battery or some other suitable power source (not shown closer). In the embodiment shown the electronic code and electric current are fed from the key to the control unit 10 through contact means 12 located in the key and corresponding contact means 13 located in the key channel 10*b*. From the contact means 13 the code is led to comparison means 15, included in the electronic unit 14 of the lock, in which the received code is compared with one or more codes stored in the electronic unit 14. The contact means 13 are not shown in FIG. 1 and are schematically shown in FIG. 2 but are conveniently located in a similar position to the contact means 13", shown in the embodiment of FIGS. 4–7.

If the received electronic code is correct, the means 16 connects electric current to the electromagnetic means included in the electric operating means 17, whereby a magnetic field affecting the locking disc 9 is created. In this case the locking disc 9 is turned with the control unit 10, until the current is interrupted, which would normally occur after the lock mechanism has been relocked and the key has been turned back to its initial position and removed from the lock. Since turning of the locking disc 9 back to its initial position occurs, however, under the influence of the protrusion 10*d* of the control unit 10 positively guiding the locking disc 9, the supply of current may be disconnected immediately after opening of the lock mechanism so as to hereby economize the batteries.

In case the electric code received from the key is not correct, current is not connected to the electromagnetic means and, thus, no magnetic field is created, whereby turning of the key in the lock does not effect opening of the lock mechanism as described above. In addition to the contact means 13 and the electric operating means 17, the comparison means 15 and the means 16 can with advantage and in order to save space be located in the control unit 10.

The electronic code of the key can be fed from the key into the lock by many different ways and techniques, and when necessary independent of current supply. This is true especially when the lock is provided with a power supply of its own. With the solution according to the shown embodiment it is possible, however, to accomplish a more uncomplicated and space saving construction for the cylinder lock.

By arranging the control unit 10 and the locking disc 9 to be located as shown at the end part of the set of locking discs 3 the supply of current and electronic code may be arranged in a simple way from the base part or root of the key shank 7*a*. In principle there is nothing to hinder locating the contact means 12 at a different location along the key shank however. Also more than one special locking disc 9 may be utilized. For instance, two special locking discs may be located one on either side of the control unit 10 or side by side.

In practice the control unit 10, which may take up about 5–6 mm of the length of the key channel, and the locking disc 9 are used in place of some of the conventional locking discs in order to avoid increasing the total length of the set of discs (including the control unit 10 and the special locking disc 9). As a consequence the number of mechanical opening combinations is correspondingly decreased. However, when the mechanical opening combinations available are combined with the numerous electronic codes, the total number of new key combinations is several times the number available in the conventional lock. This together with the magnetic control arrangement increases substantially both the security of the lock mechanism and key security.

Figure 3:
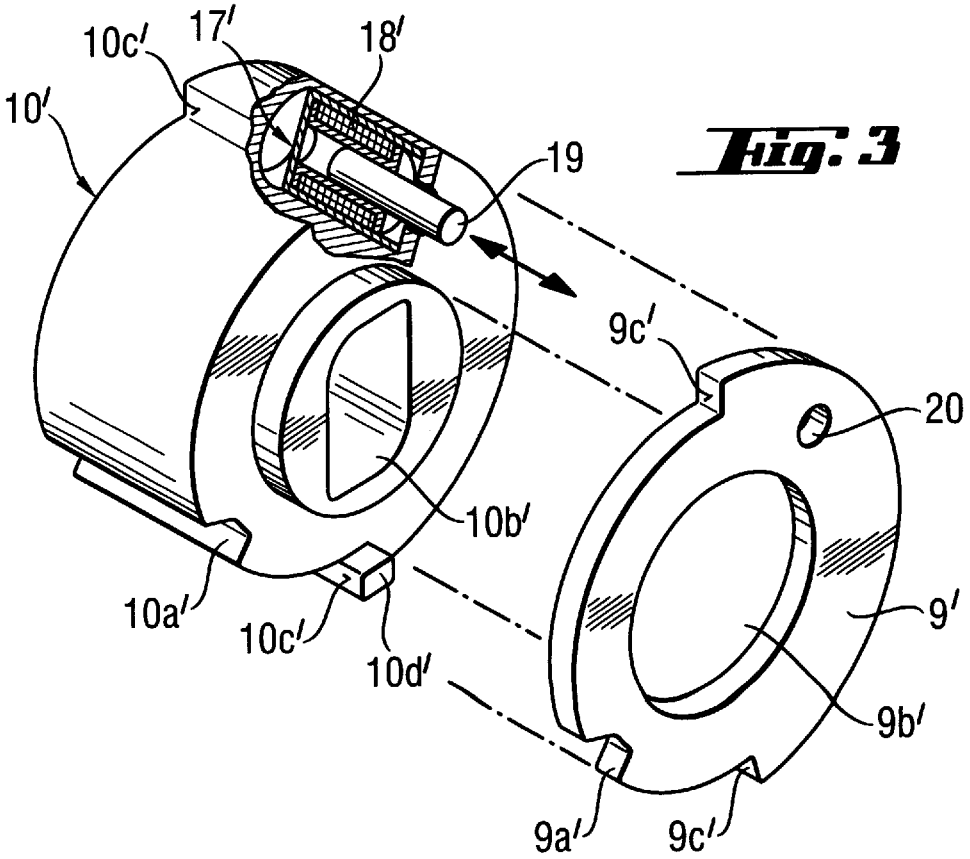
FIG. 3 shows an enlarged axonometric view of an electric operating means included in a second electromechanical cylinder lock arrangement according to the invention.

In the embodiment of FIG. 3 the control unit 10' and the locking disc 9' with their mechanical members correspond to the control unit 10 and the locking disc 9 and their members shown in FIG. 1. The solution of FIG. 3 differs, however, from the solution of FIG. 1 in that it comprises an electromagnet 18' controlling a coupling member 19 to be moved axially depending on whether or not there is current in the electromagnet 18'. This, for its part, depends on the code fed from the key. If the code is correct, the coupling member 19 moves under the influence of the electromagnet 18' from a retracted position in which it does not project from the control unit 10 to a protruding position in which it projects into an opening 20 in the locking disc 9'. Thereby when the control unit 10' is turned by the key, the locking disc 9' is turned with it through the coupling member 19. Retracting of the coupling member 19 can be arranged in many alternative ways, for instance by changing the polarity of the electromagnet, by additionally utilizing a permanent magnet or by means of a fully mechanical arrangement. In other respects the operation of this solution corresponds to the operation of the solution of FIG. 1. For example returning of the locking disc 9' to its initial position occurs under the influence of a protrusion 10*d'* of the control unit 10'.

Since the coupling in the solution of FIG. 3 is mechanical, in this case the locking disc 9' need not be of ferromagnetic material. The actual coupling member 19 may in practice be the anchor member or core of the electromagnet 18', which is relatively small in size and mass. Hence, no great power is required for moving it, whereby the solenoid to be used may be also in this case rather small, which is advantageous as to its costs, and able to economize electric power.

The embodiment of FIGS. 4–7 differs from the embodiments described above by use of movable coupling means, to be controlled by electric operating means 17" and by means of which the special locking disc 9" can be turned to an opening position of the lock mechanism, located both in the control unit 10" and in the locking disc 9". Another difference is that coupling is accomplished only when the key has already been turned somewhat, for instance about 45°, naturally provided that a correct electronic code has been fed into the lock.

With closer reference to FIGS. 4–7 the lock body 1 includes at the key insertion end of the key channel an element 21 which turns continuously with the key. The element 21 has an opening that defines the profile of keys compatible with the lock and simultaneously it serves as means to protect against drilling of the lock. The element 21 is located in a cylindrical opening in a guiding disc 22, which is held against rotation relative to the lock cylinder 2. The guiding disc 22 supports and guides the locking disc 9", which is located between the control unit 10" and the guiding disc 22.

In order to couple the turning movement of the key to the locking disc 9", the control unit 10" includes a generally cylindrical actuating member 25, which is controlled by the electromagnet 18" included in the electric operating means 17" and at the position of which there is a coupling recess 24 in the control unit 10". The coupling recess 24 has a bevelled guiding surface 24*a*. The actuating member 25 can be turned between two end positions by changing the polarity of the electromagnet 18". The inner end 25*a* of the actuating member 25 is rotationally asymmetrical.

Preferably, the inner end 25*a* of the actuating member is delimited by two parallel surfaces, in the manner of a bar.

In addition the body unit of the electromagnet 18" is provided with limiting members 27 (cf. FIG. 7) which determine the turning range (preferably 90° or less) of the actuating member 25 by engaging the parallel surfaces of the inner end 25*a*.

A spring 26 urges the actuating member toward the right of FIG. 4. When the actuating member is in one end position the inner end 25*a* engages an abutment surface which prevents the actuating member being pushed to the left whereas in the other end position, the inner end 25*a* is aligned with a slot and the actuating member 25 can be pressed against the force of the spring 26 entirely inside of the control unit 10" as apparent from FIG. 10. The arrangement includes with advantage a permanent magnet 28, which keeps the actuating member 25 in the end position corresponding to the initial position and thereby ensures that the actuating member is not affected by external magnetic fields or other disturbances, for instance shocks or vibrations.

Figure 8:
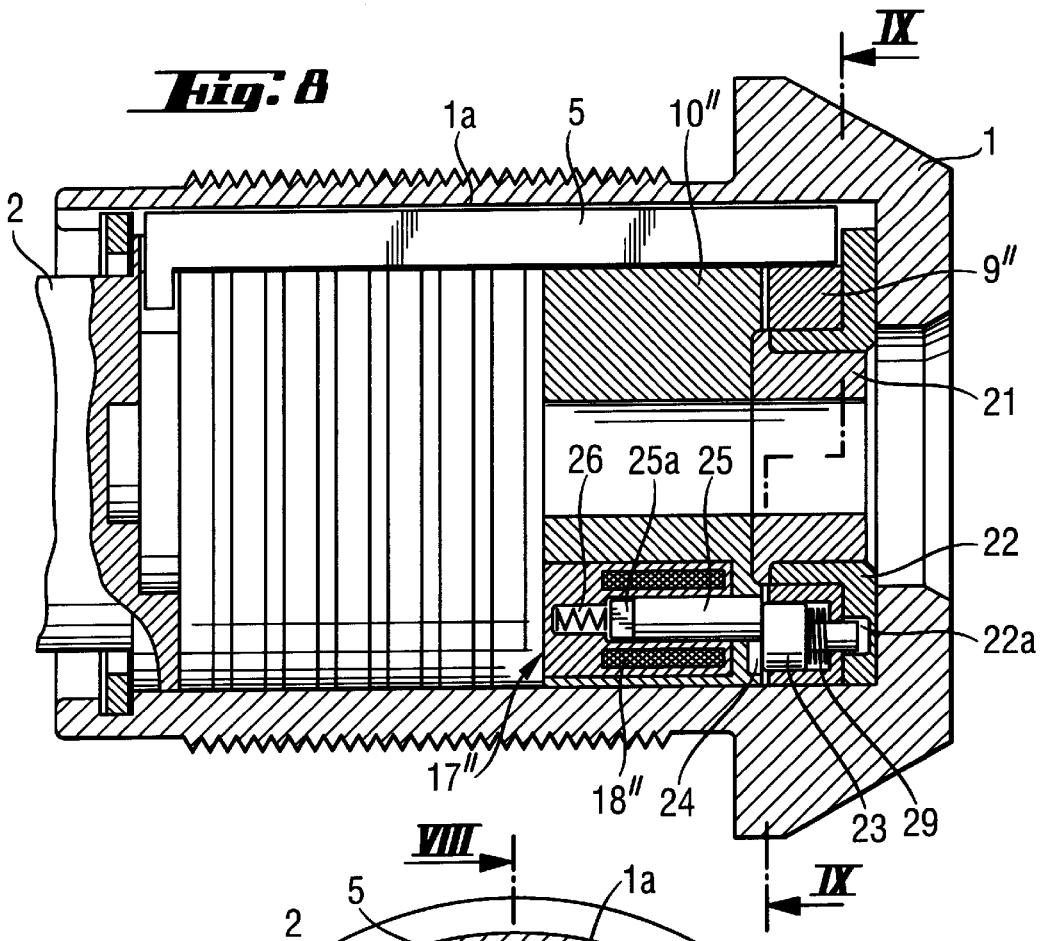
FIG. 8 shows the cylinder lock arrangement of FIG. 4 as an axial section at the position of the locking bar of the lock after turning of the key about 45° and with no correct electric code supplied.
Figure 10:
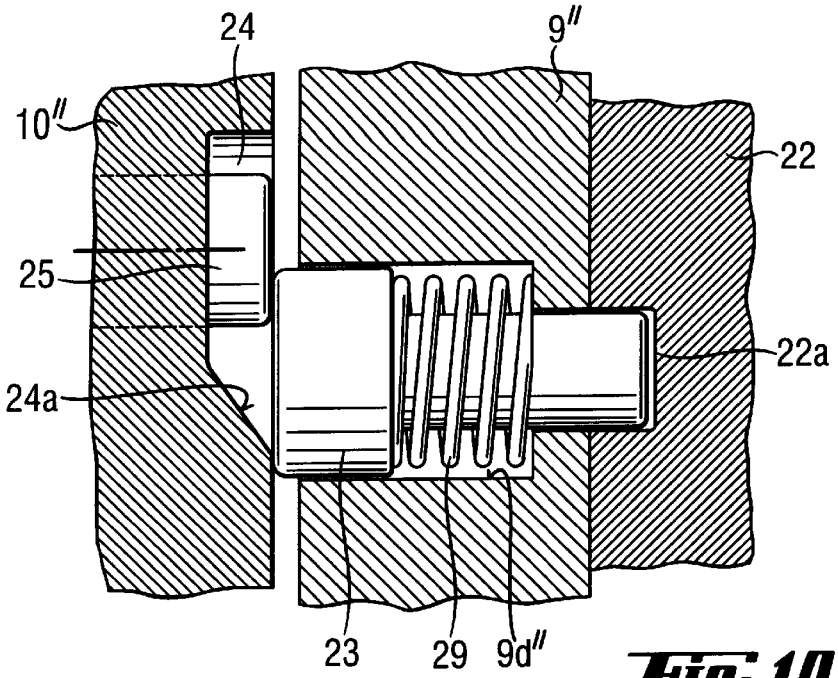
FIG. 10 shows a partial sectional view on the line X—X of FIG. 9 as an enlargement.

The locking disc 9" for its part is formed with a throughgoing hole 9*d*″ enclosing a coupling member 23, which can be pressed against the force of a spring 29 so that it extends into a recess 22*a* in the guiding disc 22, whereby the locking disc 9" is held against rotation (cf. FIGS. 8 and 10). As apparent from FIG. 5 in the initial position the 10 coupling member 23 and the recess 22*a* are located at a turning angle of about 45° from the coupling recess 24 and the actuating member 25.

The operation of the embodiment of the FIGS. 4–7 is as follows. In the initial position of the mechanism according to FIGS. 4–7, in which the key is inserted into the key channel of the lock (for a matter of clarity the key is not shown in the figures), the actuating member 25 extends, urged by the spring 26, beyond the coupling recess 24 against the locking disc 9". Further, as is shown in FIG. 10, the coupling member 23 extends into the recess 22*a* in the guiding disc 22. The coupling member 23 engages the control unit 10", which prevents the spring 29 from pushing the coupling member 23 to the left, out of engagement with the recess 22*a*. When the key is first turned in the lock, the locking disc 9" remains at its initial position due to engagement of the coupling member 23 in the recess 22*a*. After turning of the key about 45° the coupling recess 24 and the actuating member are located at the position of the coupling member 23. In the absence of a correct electric code the turning position of the actuating member 25 is not changed. Hence, the actuating member 25 prevents movement of the coupling member 23 into the coupling recess 24 and the locking disc 9" is held against rotation by the guiding disc 22 (cf. FIGS. 8–10) and the lock mechanism cannot be opened.

Figure 6:
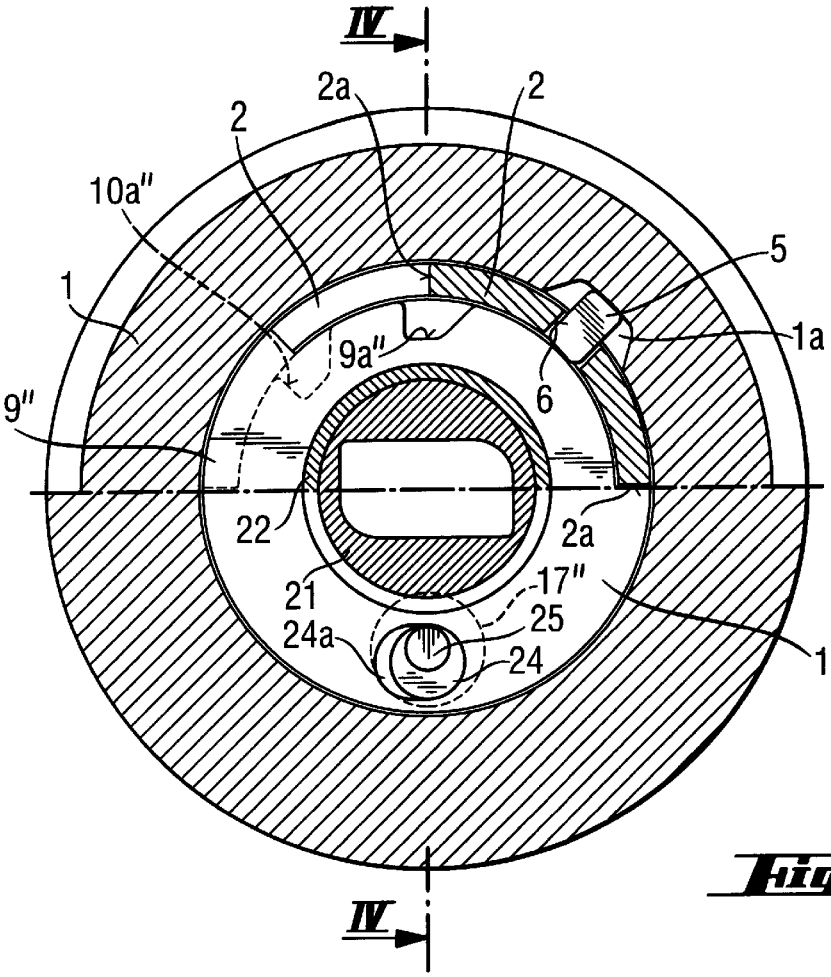
FIG. 6 shows a sectional view on the line VI—VI of FIG. 4.
Figure 7:
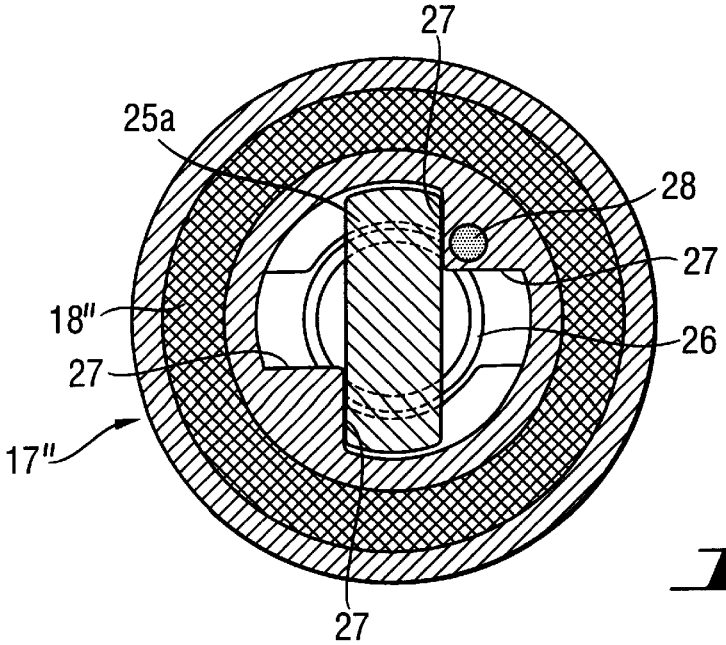
FIG. 7 shows a partial sectional view on the line VII—VII of FIG. 4 as an enlargement.
Figure 9:
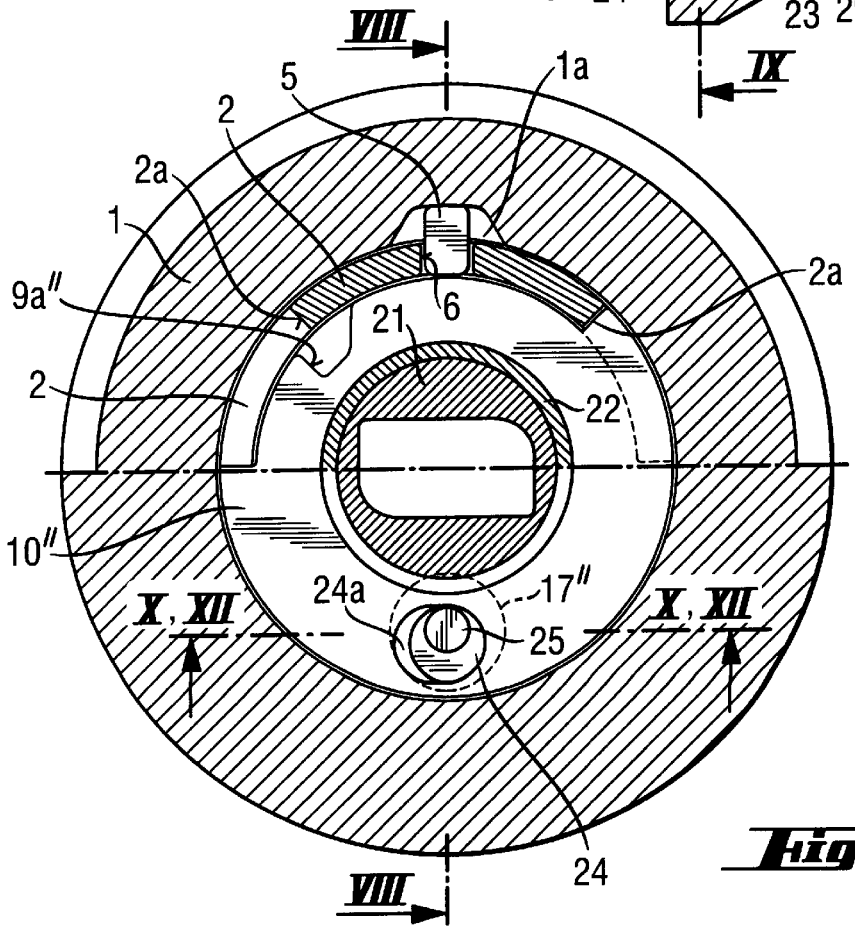
FIG. 9 shows a sectional view on the line IX—IX of FIG. 8.
Figure 11:
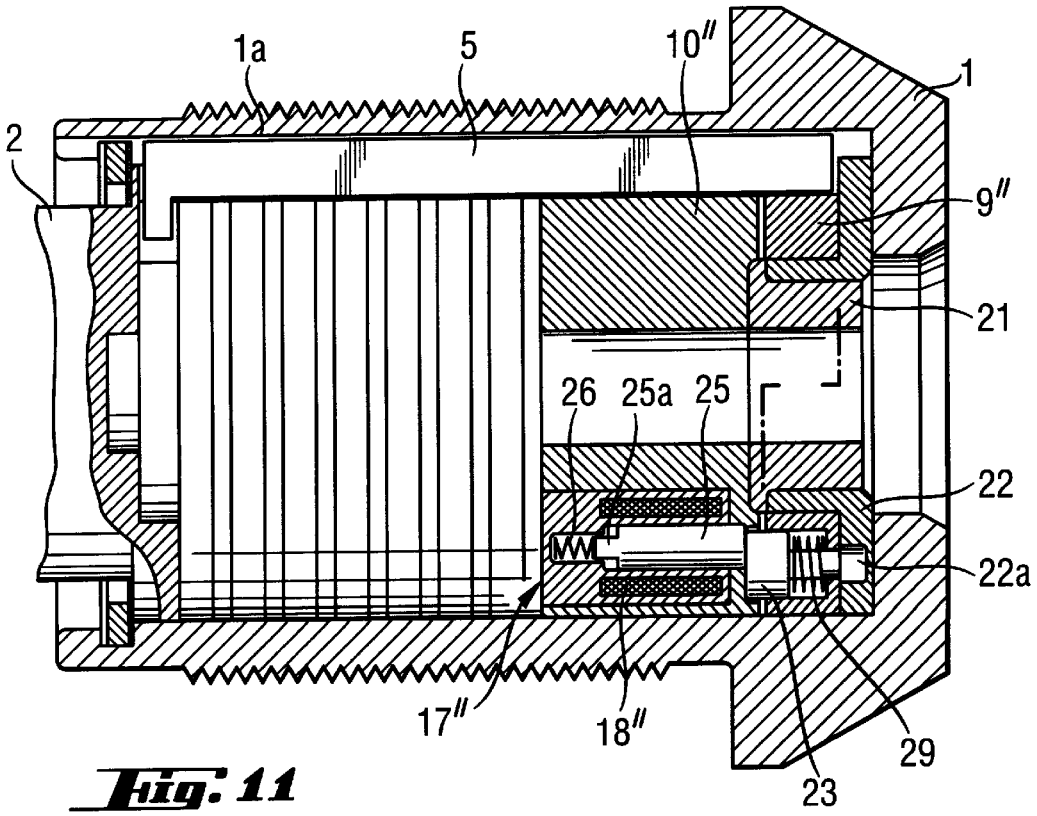
FIG. 11 shows the cylinder lock arrangement of FIG. 4 as an axial section at the position of the locking bar of the lock after turning of the key about 45° and with a correct electric code supplied.
Figure 12:
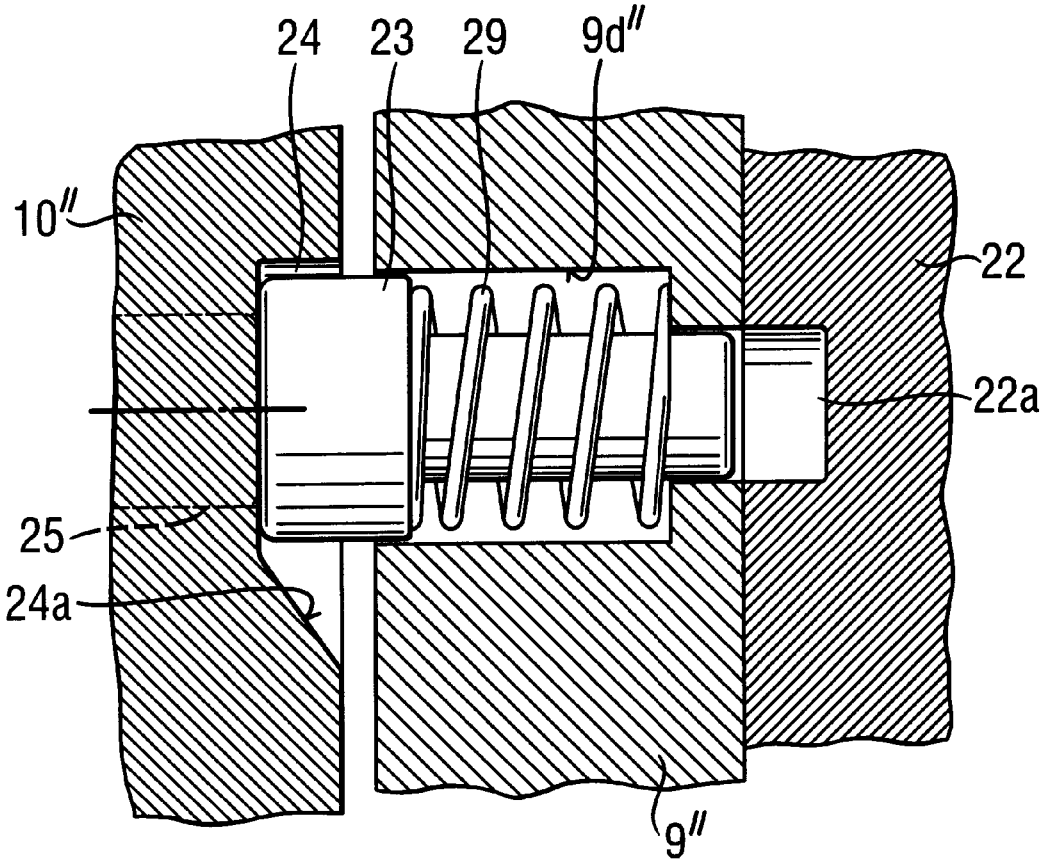
FIG. 12 shows a partial sectional view on the line XII—XII of FIG. 9 as an enlargement with the members in an operating position corresponding to the situation of FIG. 11.

FIGS. 11 and 12 for their part show the operation when a correct electric code is fed into the lock. As a result of the code a control command is provided, which changes the polarity of the electromagnet 18". Thereby the actuating member 25 is turned 90° so that its inner end 25*a* is aligned with the slot and the actuating member 25 is pressed to the left by the coupling member 23 and its spring 29 against the force of the spring 26 to a position allowing the coupling member 23 to enter the coupling recess 24. The coupling member 23 is thereby released from the recess 22*a* in the guiding disc 22. As a consequence when the key is turned further the locking disc 9" turns with it so that its peripheral notch 9*a*″ shown in FIGS. 6 and 9 is located at the 10 position of the locking bar 5 thereby allowing for its part opening of the lock mechanism.

In contrast to the embodiments of FIGS. 1 and 3, in this embodiment the returning of the locking disc 9" does not require a separate protrusion 10*d* or 10*d*′ on the control unit 10", but the locking disc 9" turns under the influence of the coupling recess 24 and the coupling member 23 back to its initial position, which is determined by the guiding surface 2*a* of the lock cylinder and in which the coupling member 23 is at the position of the recess 22*a* in the guiding disc 22. When the key is turned further, the disc 9" cannot turn due to engagement with the guiding surface 2*a* and the coupling member 23 is urged into the recess 22*a* against the force of the spring 29 urged by the guiding surface 24*a* in the coupling recess 24 (cf. FIGS. 12 and 10). At the same time the spring 26 urges the actuating member 25 to the right so the inner end 25*a* is released from the slot and the actuating member 25 is turned back to the initial position according to FIG. 4 due to the changed polarity of the electromagnet 18".

Since the coupling member 23 is engaged with the recess 22*a*, the disc 9" is held against rotation relative to the guiding disc 22.

The operation of the actuating member 25 does not necessarily need a separate spring 26, but a corresponding operation can be accomplished through suitable design of the end 25*a* and of the counter surfaces in the body part cooperating therewith.

There are many alternative ways to provide a coupling for the special locking disc. One further way could be based on the embodiment of FIG. 3 modified in view of the embodiment of FIGS. 4–7 so as to make use of a turning range of the special locking disc for releasing the lock mechanism to be less than the whole turning range of the key for selecting the opening combination. Then at the initial position the special locking disc could be always coupled to the control unit by means of a coupling member located in the control unit and e.g. a permanent magnet located in the lock body or in a guiding disc or the like so as to be turnable together with it by means of the key. Then in the absence of a correct code the special locking disc is turned continuously beyond the correct turn for releasing the lock. On the other hand on the occurrence of a correct code the electric operating means could be activated so as to disengage the coupling after certain turning angle when the special locking disc is moved out of the effective magnetic field of the permanent magnet. Thereafter the locking disc could be further moved a correct turning angle, i.e. less than the full range of turning, by means of an additional protrusion arranged in the control unit so as to place it at the correct position for releasing the locking mechanism.

In addition to the lock mechanism more closely shown in FIG. 1 the solution according to the invention may naturally be applied also to a number of other cylinder lock mechanisms based on rotatable locking discs, for instance the conventional cylinder lock mechanism, which does not include a return bar 8 but in which returning of the locking discs to their initial position is accomplished directly by the key of the lock, as well as bidirectionally operable locking disc mechanisms.

In addition the invention may be applied to entirely different cylinder lock mechanisms such as the so-called pin tumbler mechanisms. Since in this case the lock cylinder is not hollow in the same way, the control unit and the special locking disc should be located at the end of the cylinder barrel outside thereof. In addition a separate locking member arrangement is needed for the special locking disc, for instance a member corresponding to the locking bar, which acts on both the control unit and on the special locking disc so that it does not allow turning of the lock cylinder and the control unit to the final end position as required by the application in each case without turning the special locking disc correspondingly a selected turning angle so as to make releasing of the locking bar possible. Hence, also in this case the lock cannot be opened by a key provided merely with a correct mechanical opening combination, even if the lock cylinder could be turned somewhat, until a correct electronic key code is fed, and as a consequence thereof power supply to the electromagnetic means in the control unit is connected, whereby the special locking disc turns with the key and the control unit to a position in which the locking bar or the like is released so as to allow further turning of the members.

Thus, the invention is not restricted to the embodiments shown, but several modifications are feasible within the scope of the attached claims.

What is claimed is:

1. An electromechanical cylinder lock and key arrangement comprising:

a key that embodies a mechanical combination and includes a code transmitter for transmitting an electronic code, and a lock including a lock body, a turnable lock cylinder and a locking mechanism inside the lock body, the locking mechanism comprising a locking means which normally prevents turning of the lock cylinder relative to the lock body and which can be moved by means of the key into a releasing position allowing turning of the lock cylinder, a receiver means for receiving and identifying the electronic code transmitted by the code-transmitter of the key and comparing the received code with a stored code so that if the received code matches the stored code said receiver means enables mechanical opening of the lock by means of the key, a locking disc with a key opening which is so designed that the turning of the key does not directly act mechanically on the locking disc, and an electric operating means to be activated by means of the electronic code from the key, the electric operating means including a coupling means having a first state in which the coupling means allows the key to turn relative to the locking disc and a second state in which the coupling means couples turning movement of the key to the locking disc so that said locking disc turns with the key to a position required for opening the locking mechanism.

2. An arrangement according to claim 1, wherein the lock includes a control unit which turns with the key when the key is inserted in the lock and to which the electric operating means is mounted.

3. An arrangement according to claim 2, wherein the key includes a shank part having a selected cross-sectional profile and the control unit has a key channel of cross-section corresponding to the cross-sectional profile of the shank part of the key, and the control unit includes the receiver means.

4. An arrangement according to claim 2, wherein the key includes a power source and an electric contact means and the control unit includes an electric contact means which cooperates with the electric contact means of the key for supplying electric current from the power source to the electric operating means.

5. An arrangement according to claim 4, wherein the receiver means includes a means for controlling supply of electric current from the electric contact means of the control unit depending on whether the received code matches the stored code.

6. An arrangement according to claim 4, wherein the control unit has a key channel for receiving the key and the electric contact means of the control unit is exposed at the interior of the key channel.

7. An arrangement according to claim 2, wherein the control unit is turnable relative to the lock cylinder through a limited angular range from an initial position.

8. An arrangement according to claim 1, wherein the lock includes a control unit which turns with the key when the key is inserted in the lock and the coupling means is in its second state for coupling the control unit to the locking disc, for turning the locking disc when the control unit is turned by the key.

9. An arrangement according to claim 8, wherein the control unit and the locking disc are turnable relative to the lock cylinder from an initial position through a limited angular range when the coupling means is in its second state.

10. An arrangement according to claim 1, wherein the lock includes a control unit which turns with the key when the key is inserted in the lock and the control unit includes a formation that acts on the locking disc when the control unit has been turned from an initial position in a first direction, for releasing the lock, and the control unit is then turned in a second direction, opposite to the first direction, for returning the locking disc to the initial position.

11. An arrangement according to claim 1, wherein the coupling means includes an electromagnetic means and the locking disc is ferromagnetic.

12. An arrangement according to claim 11, wherein the lock includes a control unit in which the electromagnetic means is mounted and the locking disc is located adjacent the control unit, so that when the electromagnetic means is energized, the locking disc is clamped magnetically to the control unit.

13. An arrangement according to claim 1, wherein the lock includes a control unit which turns with the key when the key is inserted in the lock and the coupling means includes a coupling member which is movable by the electric operating means from a free, non-coupling position, in which the control unit is turnable relative to the locking disc, to a coupling position, in which the coupling member mechanically engages the locking disc and the locking disc turns with the control unit when the control unit is turned by the key.

14. An arrangement according to claim 1, wherein the coupling means includes a spring-loaded coupling member which is mounted in the locking disc and is movable transversely of the locking disc between a first end position and a second end position, in each of which it projects from the locking disc, and the electric operating means controls movement of the coupling member for controlling turning of the locking disc.

15. An arrangement according to claim 14, wherein the electric operating means comprises an actuating member and a means for turning the actuating member between first and second turning positions, and the lock includes a means allowing movement of the actuating member in a first axial direction in its first turning position and preventing movement of the actuating member in said first axial direction in its second turning position.

16. An arrangement according to claim 14, wherein in the first end position of the coupling member the locking disc is turnable relative to the lock body and in the second end position of the coupling member the locking disc is held against turning relative to the lock body.

17. An arrangement according to claim 16, wherein the electric operating means comprises an actuating member and a means for turning the actuating member between first and second turning positions, and the lock includes a means allowing movement of the actuating member in a first axial direction in its first turning position and preventing movement of the actuating member in said first axial direction in its second turning position, and wherein the actuating member is positioned to cooperate with the coupling member so that when the actuating member is in the first turning position the actuating member allows movement of the coupling member from its second end position to its first end position and when the actuating member is in the second turning position the actuating member prevents movement of the coupling member from its second end position to its first end position.

18. An arrangement according to claim 17,,wherein the lock includes a control unit which turns with the key when the key is inserted in the lock and the control unit is formed with a coupling recess for receiving the coupling member when the coupling member is in its first end position and for receiving the actuating member when the actuating member is in its second turning position.

19. An arrangement according to claim 18, wherein at an initial position of the key in the lock the coupling member is at a predetermined angle from the coupling recess so that when the key is turned through said predetermined angle from the initial position the coupling member and the coupling recess are aligned.

20. An arrangement according to claim 18, wherein the lock includes a guiding disc that is held against turning relative to the lock cylinder and the locking disc is located between the control unit and the guiding disc, the guiding disc being formed with a coupling recess for receiving the coupling member in its second end position, whereby the locking disc is held against turning relative to the lock cylinder.

21. An arrangement according to claim 14, wherein the lock includes a guiding disc that is held against turning relative to the lock cylinder and is adjacent the locking disc, the guiding disc being formed with a coupling recess for receiving the coupling member in its second end position, whereby the locking disc is held against turning relative to the lock cylinder.

22. An arrangement according to claim 21, wherein the lock includes a control unit which turns with the key when the key is inserted in the lock and the locking disc is located between the control unit and the guiding disc.

23. An arrangement according to claim 1, wherein the lock cylinder is formed with an axial slot and the lock mechanism includes a set of locking discs which are mechanically turnable by the key, the locking discs of the lock mechanism are located inside the lock cylinder and each is formed with a peripheral notch, the locking means further includes a locking bar which has a locking position in which it prevents turning of the lock cylinder relative to the lock body and is movable to a releasing position in which it allows turning of the lock cylinder relative to the lock body when the locking discs of the lock mechanism are positioned so that their peripheral notches form a channel at the position of the slot of the lock cylinder, and the lock includes a control unit which is located inside the lock cylinder and turns relative to the lock cylinder with the key when the key is inserted in the lock, the control unit being formed with a groove for receiving the locking bar when the groove is at the position of the slot of the lock cylinder.

24. An arrangement according to claim 23, wherein the electric operating means is disposed in the control unit.

25. An arrangement according to claim 23, wherein the control unit is turnable relative to the lock cylinder through a limited angular range from an initial position.

26. An arrangement according to claim 1, wherein the locking means comprises a pin tumbler mechanism.

* * * * *